US006650055B2

(12) United States Patent
Ishimoto et al.

(10) Patent No.: US 6,650,055 B2
(45) Date of Patent: Nov. 18, 2003

(54) DISPLAY DEVICE

(75) Inventors: Manabu Ishimoto, Kawasaki (JP); Tsutae Shinoda, Kawasaki (JP); Akira Tokai, Kawasaki (JP); Hitoshi Yamada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/102,869

(22) Filed: Mar. 22, 2002

(65) Prior Publication Data

US 2003/0048077 A1 Mar. 13, 2003

(30) Foreign Application Priority Data

Sep. 13, 2001 (JP) ..... 2001-278506

(51) Int. Cl.[7] ..... H01J 17/18
(52) U.S. Cl. ..... 313/623; 313/486
(58) Field of Search ..... 313/623, 484, 313/485, 486, 618, 624, 625, 631, 632, 306, 307, 311

(56) References Cited

U.S. PATENT DOCUMENTS

2002/0030437 A1 * 3/2002 Shimizu et al.

FOREIGN PATENT DOCUMENTS

JP 11-162358 * 6/1999

* cited by examiner

*Primary Examiner*—Don Wong
*Assistant Examiner*—Thuy Vinh Tran
(74) *Attorney, Agent, or Firm*—Staas & Halsey LLP

(57) ABSTRACT

A display device includes an elongated display tube to be filled with a discharge gas and provided with a phosphor layer therein, a supporter in contact with the display tube for supporting the display tube, and a plurality of electrodes arranged on a surface of the supporter facing the display tube, for externally applying a voltage to the display tube for generating discharge in the display tube so as to perform a display. The supporter has a shape fitting the display tube whereby the electrode is in contact with the display tube along the surface shape of the display tube.

14 Claims, 7 Drawing Sheets

DISPLAY DEVICE

CROSS-REFERENCE TO RELATED APPLICATION

This application is related to Japanese application No. 2001-278506 filed on Sep. 13, 2001, whose priority is claimed under 35 USC §119, the disclosure of which is incorporated by reference in its entirety.

BACKGROUND OF THE INVENTION

1. Field of the Invention

The present invention relates to a display device, and more particularly to a display device for displaying an optional image, wherein a plurality of elongated gas discharge tubes are arranged in parallel.

2. Description of the Related Art

The present inventors filed Japanese Patent Application NO. 2001-276941 relating to a display device having a plurality of elongated gas discharge tubes arranged in parallel for displaying an optional image.

FIG. 6 shows this display device. In the figure, numeral 31 denotes a front side substrate, 32 a back side substrate, 1 a gas discharge tube, 2 a display electrode pair and 3 a data electrode.

A phosphor (fluorescent) layer (not shown) is provided in the gas discharge tube 1 that is an elongated tube. A discharge gas is filled in this gas discharge tube 1. The data electrode 3 is formed on the back side substrate 32 so as to be arranged along the longitudinal direction of the gas discharge tube 1. The display electrode pair 2 is formed on the front side substrate 31 so as to be arranged in the direction perpendicular to the data electrode 3.

When this display device is seen from the top, the intersectional point of the data electrode 3 and the display electrode pair 2 becomes a unit light-emitting area. With respect to display, one of the display electrode pair 2 is used as a scanning electrode for generating a selective discharge between the scanning electrode 2 and the data electrode 3 to thereby select a light-emitting area. Thereafter, a display discharge is generated with the display electrode pair 2 by utilizing wall charges formed by the selective discharge on the inner surface of the tube at the selected light-emitting area, whereby the phosphor layer emits light to execute the display. The selective discharge is a counter discharge generated in the gas discharge tube 1 between the scanning electrode and the data electrode 3 that are opposite to each other in a vertical direction. The display discharge is a surface discharge generated in the gas discharge tube 1 at the display electrode pairs arranged parallel to one another on a plane.

In the display device having a great number of such gas discharge tubes arranged therein, the display electrode pair 2 has an electrode structure shown in FIG. 7 or shown in FIG. 8.

The electrode structure shown in FIG. 7 has the display electrode pair 2 formed on the inner surface of the front side substrate 31 as shown in the above-mentioned FIG. 6. The display electrode pair 2 is arranged so as to be in contact with the outer wall surface of the gas discharge tube 1 upon assembling.

The electrode structure shown in FIG. 8 has the display electrode pair 2 that has already been formed on the outer surface of the gas discharge tube 1 by a printing method or vapor-deposition method. Formed on the front side substrate 31 is an electrode 2*a* for an electric power supply. This electrode 2*a* for the electric power supply is arranged so as to be in contact with the display electrode pair 2 of the gas discharge tube 1 upon assembling.

However, the contact area between the display electrode 2 and the gas discharge tube 1 is small in the display device having the electrode structure shown in FIG. 7, which leads to an excessive small effective electrode area. Therefore, a discharge D between the display electrodes 2 is small, to thereby entail a problem of dark display luminance.

The display device having the electrode structure shown in FIG. 8 requires an alignment between the display electrode 2 formed on the gas discharge tube 1 and the electrode 2*a* for the electric power supply.

SUMMARY OF THE INVENTION

The present invention is accomplished in view of the above circumstances, and aims to improve a display luminance of a display device by enlarging a contact area between a display electrode and a gas discharge tube without forming an electrode on the gas discharge tube.

The present invention provides a display device comprising: an elongated display tube to be filled with a discharge gas and provided with a phosphor layer therein; a supporter in contact with the display tube for supporting the display tube; and a plurality of electrodes arranged on a surface of the supporter facing the display tube, for externally applying a voltage to the display tube to generate discharge in the display tube so as to perform a display, wherein the supporter has a shape fitting the display tube whereby the electrode is in contact with the display tube along the surface shape of the display tube.

According to the present invention, the supporter has a shape along the display tube, by which the electrode is in contact with the display tube along the surface shape of the display tube. Therefore, the contact area between the electrode and the display tube becomes a curved surface, whereby the electrode and the display tube sufficiently contact with each other. This can assure a sufficient effective area of a discharge electrode, thereby improving the display luminance of the display device.

BRIEF DESCRIPTION OF THE DRAWINGS

The present invention will become more fully understood from the detailed description given hereinbelow and the accompanying drawings that are given by way of illustration only, and thus are not to be considered as limiting the present invention.

DESCRIPTION OF THE PREFERRED EMBODIMENT

Figure 1:
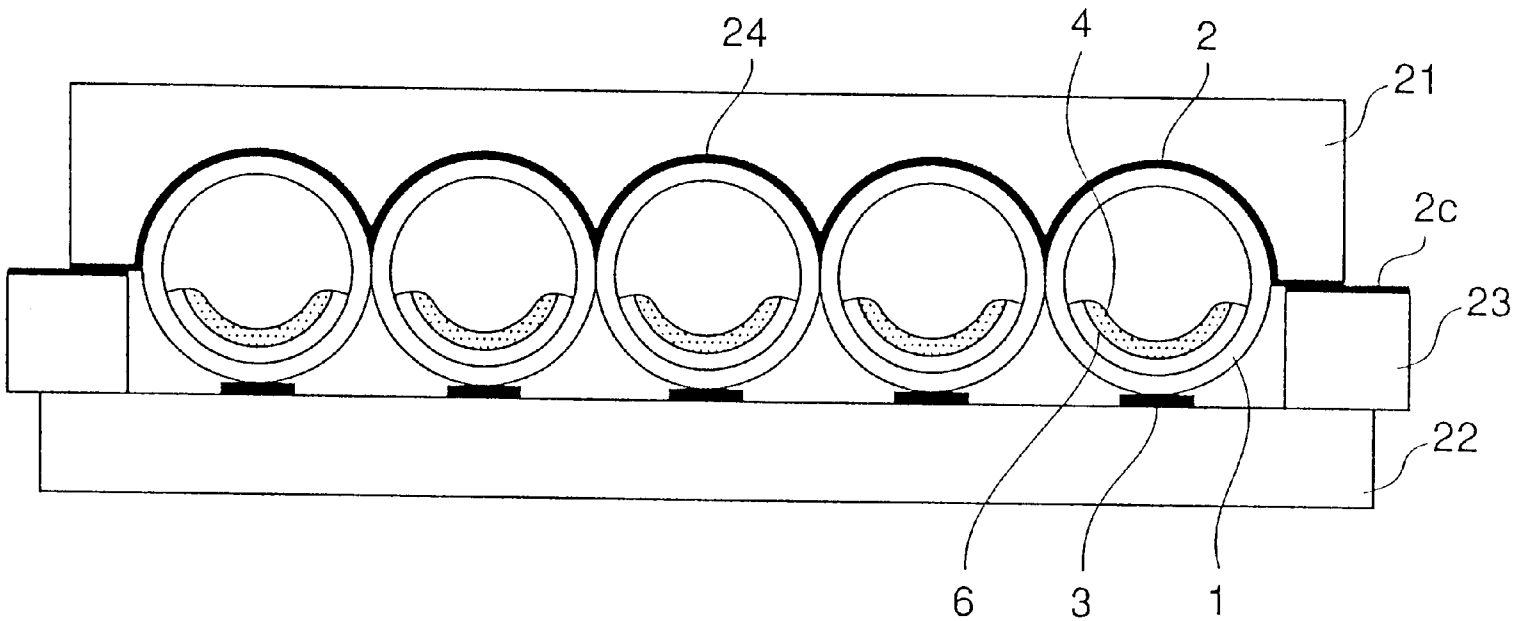
FIG. 1 is an explanatory view showing a structure of a display device in a preferred embodiment 1 according to the present invention.

The display device of the present invention has a plurality of elongated gas discharge tubes arranged in parallel for displaying an optional image. Each of the elongated gas discharge tube arranged in parallel may have any diameter. From the view point of the image display, an elongated gas discharge tube having a diameter of about 0.5 to 5 mm is generally used.

In the present invention, the display tube may be an elongated tube filled with a discharge gas and provided with a phosphor layer. Its diameter and sectional shape are not specifically limited. From the view point of the image display, an elongated gas discharge tube having a diameter of about 0.5 to 5 mm is generally used for the display tube. Although the electrode is not necessarily formed on the outer wall surface of the display tube of the present invention, it may be formed thereon.

The electrode may be arranged on a surface of the supporter opposite to the display tube. The electrode is the one that externally applies a voltage to the display tube for causing discharge in the display tube so as to execute the display. The electrode can be formed by a method well known to those skilled in the art such as a printing method, a vapor-deposition method or the like. Various materials can be used for the electrode. For example, Cu, Cr, Al, Au, Ag or the like can be used for the electrode.

In the present invention, the supporter may have a structure for supporting the display tube by coming in contact with the display tube. Further, the supporter may have a shape along the display tube such that the electrode comes in contact with the display tube along the surface shape of the display tube. Accordingly, the shape of the supporter is not specifically limited. It may be a flat plate shape or may be a curved surface shape.

The supporter may be composed of a pair of substrates, at least one of which has a transparency, wherein the display tube is sandwiched between the pair of substrates. In this case, at least one of the substrates having a transparency may have a recess portion along the surface shape of the display tube.

The supporter may also be composed of a substrate having a rigidity and a flexible sheet having a transparency, wherein the display tube is sandwiched between the substrate and the flexible sheet. In this case, the flexible sheet is laminated along the surface shape of the display tube.

The supporter may also be composed of a pair of flexible sheets, at least one of which has a transparency, wherein the pair of flexible sheets are laminated so as to sandwich the display tube. This allows the deformation of the pair of flexible sheets in the direction perpendicular to the longitudinal direction of the display tube.

The present invention further provides a display device comprising: a tube array in which a plurality of elongated display tubes are arranged in parallel, each of said plurality of elongated tubes being filled with a discharge gas and provided with a phosphor layer; a pair of supporters in contact with the tube array, for supporting the tube array; a plurality of display electrode pairs arranged on a surface of one of the supporters facing the tube array in a direction crossing the display tubes, for externally applying voltage to each of the display tubes to generate a display discharge in each of the display tubes; and data electrodes arranged in parallel to the display tubes on a surface of the other of the supporters facing the tube array, for generating a selective discharge between the display electrodes and the data electrodes, wherein at least one of the supporters has a shape fitting the display tubes, whereby the display electrode pairs are in contact with the display tubes along the surface shape of the display tubes.

This structure may be modified such that the supporter is composed of a pair of substrate, at least one of which has a transparency, and the tube array is sandwiched between the pair of substrates. In this case, at least one substrate having the transparency may have a recess portion along the surface shape of each display tube.

Further, the display device of the invention may have a structure such that the supporter is composed of a substrate having a rigidity and a transparent flexible sheet, wherein the tube array is sandwiched between the substrate and the flexible sheet. In this case, the flexible sheet is formed to have a shape along the surface shape of each display tube.

Additionally, the display device of the invention may have a structure such that the supporter is composed of a pair of flexible sheets, at least one of which has a transparency. The pair of flexible sheets is laminated so as to sandwich the tube array for so that the supporter can be deformed in the direction perpendicular to the longitudinal direction of the display tube.

The transparent flexible sheet may have a pair of display electrodes pair incorporated therein in the above-mentioned structure.

The display electrodes are desirably composed of transparent electrodes and bus electrodes.

The present invention will be explained in detail hereinbelow with reference to the drawings, by which the present invention is not limited and various modifications can be applied thereto.

Embodiment 1

FIG. 1 is an explanatory view showing a structure of a display device in the preferred embodiment 1 of the present invention. This figure shows a state in which a gas discharge tube 1 is cut along a display electrode 2.

Figure 6:
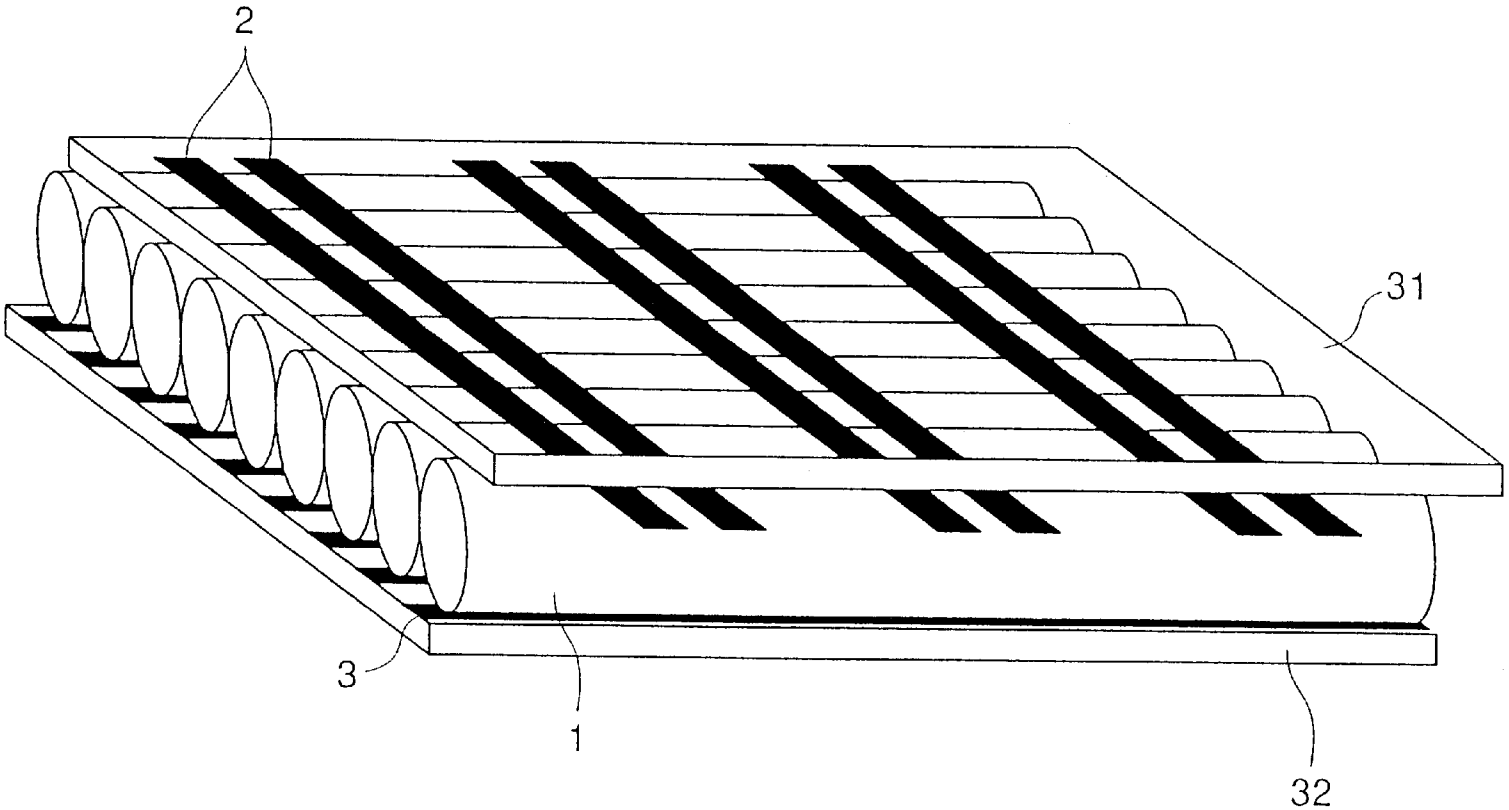
FIG. 6 is an explanatory view showing a display device disclosed in the earlier filed application wherein an optional image is displayed by arranging a plurality of elongated gas discharge tubes in parallel.

In the figure, numeral 1 denotes the gas discharge tube 1, 2 the display electrode pair, 3 a data electrode, 4 a phosphor layer, 6 a plate for the phosphor layer, 21 a front side (visual side) substrate, 22 a back side substrate, 23 a spacer, and 2*c* a connecting terminal. The front side substrate 21, the back side substrate 22 and the spacer 23 are made of a soda-lime glass. The front side substrate 21 and the back side substrate 22 have rigidity and function as a supporter for the gas discharge tubes 1 arranged in array. The arrangement of the electrodes in case that the display device is seen from the top is the same as the display device shown in FIG. 6.

The connecting terminal 2*c* is formed on the spacer 23. It is connected to the display electrode pair 2 for externally supplying an electric power to the display electrodes 2.

A transparent glass substrate is used for the front side substrate 21. Formed on the inner surface of the front side substrate 21 is each display electrode pair 2 arranged in the direction crossing each of the gas discharge tubes 1. Each of the display electrode pairs 2 is formed so as to come in contact with each gas discharge tube 1 along the outer wall surface thereof. Formed at the inner surface of the back side substrate 22 is each data electrode 3 arranged in the longitudinal direction of each gas discharge tube 1. Each of the data electrodes 3 is formed so as to come in contact with each gas discharge tube 1 along the outer wall surface thereof.

The display electrode pair 2 is made of a transparent electrode such as ITO and a bus electrode comprised of a metal. The data electrode 3 is made only of a metal since it is arranged on the back side substrate 22 that does not have to transmit light. These electrodes are formed by a method well known to those skilled in the art such as the printing method or vapor-deposition method.

The plate for the phosphor layer on which the phosphor layer 4 is formed is mounted inside of each gas discharge tube 1.

The display device of the present invention has a structure such that the discharge generated by the plurality of display electrode pairs 2 arranged come in contact with each gas discharge tube 1 along the outer wall surface thereof causes the phosphor layer 4 in the gas discharge tube 1 to be luminescent, whereby a great number of light-emitting points (display portions) can be obtained in one gas discharge tube 1. Specifically, the display device of the present invention has gas discharge tubes 1 arranged in array and manufactured by a transparent insulator (boron silicate glass), each of which having a diameter of 2 mm or less and a length of 300 mm or more.

The plate 6 for the phosphor layer is manufactured by a boron silicate glass. It has a structure independent of the tubular vessel (glass tube) of the gas discharge tube 1. The phosphor layer 4 is formed on this plate 6. Accordingly, a phosphor paste is applied on the plate 6 at the outside of the glass tube, followed by burning the resultant to thereby form the phosphor layer 4 on the plate 6, and then, the plate 6 can be inserted in the glass tube. Various phosphor pastes well known to those skilled in the art can be utilized. The phosphor layer 4 may be formed directly on the inner wall surface of the glass tube, instead of forming on the plate 6 for the phosphor layer.

The display electrode pair 2 and the data electrode 3 can cause the discharge gas in the tube to generate the discharge by applying a voltage thereto. The display device in the figure has the electrode structure in which three electrodes are arranged at one light-emitting portion, whereby the display discharge is generated by the display electrode pair. However, the electrode structure is not limited to the above-mentioned one. For example, the display discharge may be generated between the display electrode 2 and the data electrode 3.

Specifically, a single display electrode 2 is used instead of the pair of the display electrodes. This display electrode 2 is used as the scanning electrode for generating the selective discharge and the display discharge (counter discharge) between the display electrode 2 and the data electrode 3.

An electron emission layer may be formed on the inner wall surface of the glass tube. The electron emission layer produces charged particles by colliding with the discharge gas having energy of the predetermined value or higher.

The discharge gas filled in the tube is excited by the application of the voltage to the display electrode pair 2. The phosphor layer 4 emits visible light with vacuum ultraviolet light generated in the deexcitation process of the excited rare gas atoms.

Figure 8:
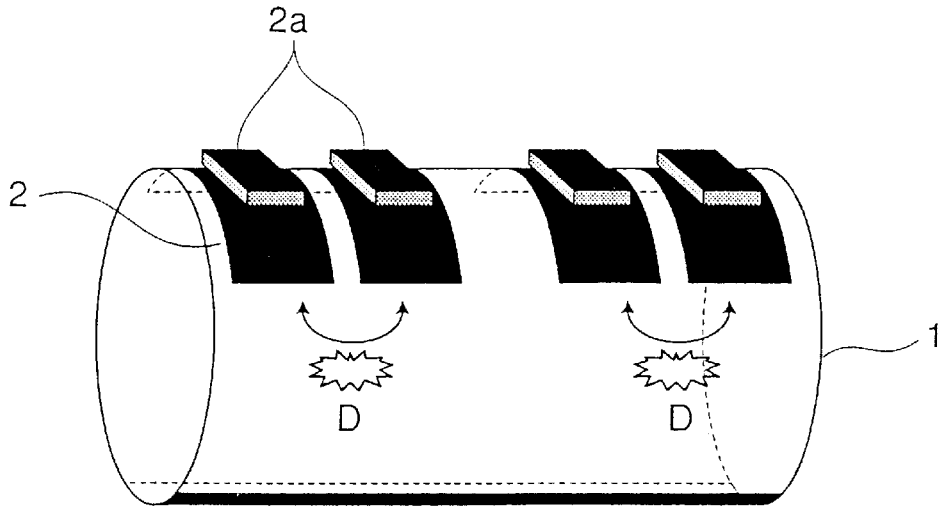
FIG. 8 is an explanatory view showing a contacting state between an electrode and a gas discharge tube in the earlier filed application.

The front side substrate 21 is formed to have recess portions 24 each corresponding to the shape of the gas discharge tube 1, and the display electrode pair 2 is formed so as to cross each recess portion 24. Each gas discharge tube 1 is fitted into each recess portion 24 so that the display electrode pair 2 comes in contact with the outer wall surface of the gas discharge tube 1. The display is performed by the luminescence of the phosphor layer caused by the discharge of the display electrode pair. The curved surface of the recess portion 24 on the front side substrate 21 is the same as that of the gas discharge tube 1, resulting in that the surface of the front side substrate 21 on which the display electrode pair 2 is formed comes in close contact with the outer wall surface of the gas discharge tube 1. Accordingly, the contact area between the display electrode pair 2 and the gas discharge tube 1 is equivalent to the one shown in FIG. 8 wherein the display electrode pair is directly formed on the gas discharge tube 1. Specifically, the present invention in which the electrode is not formed on the outer wall surface of the gas discharge tube 1 with the printing method or the like can afford the same effect as obtained by the one in which the electrode is formed on the outer wall surface of the gas discharge tube. The electrode may be formed on the outer wall surface of the gas discharge tube 1 if there is no problem with respect to the alignment.

This structure enlarges the contact area between the display electrode pair 2 and the gas discharge tube 1, thereby improving the display luminance of the display device.

The front side substrate 21 may be provided with a recess portion having the shape of the electrode at the position where the display electrode 2 is arranged. The display electrode 2 may be embedded into this recess portion so as not to project from the inner surface of the front side substrate 21. In this case, only one of the transparent electrode and the bus electrode (desirably the bus electrode) may be embedded into the recess portion.

Like the front side substrate 21, the back side substrate 22 may be provided with a recess portion having the shape of the electrode at the position where the data electrode 3 is arranged. The data electrode 3 may be embedded into this recess portion so as not to project from the inner surface of the back side substrate 22.

Figure 7:
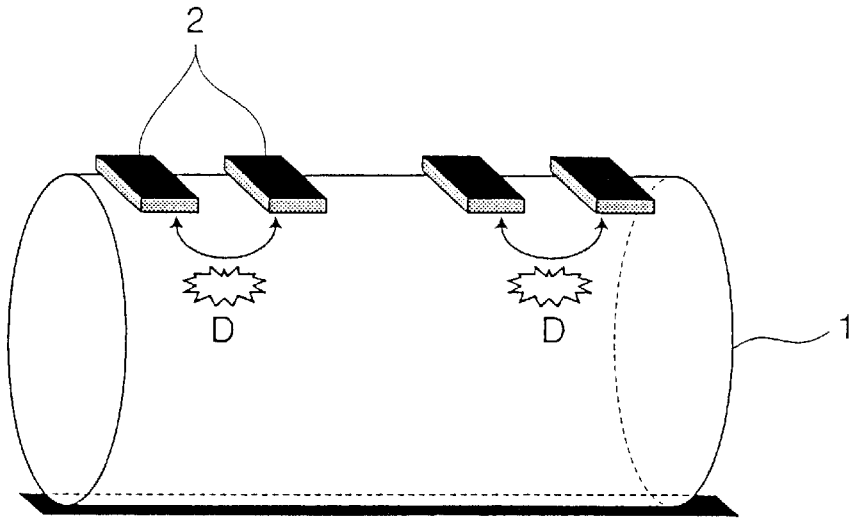
FIG. 7 is an explanatory view showing a contacting state between an electrode and a gas discharge tube in the earlier filed application.

The gas discharge tube 1 is fixed to the front side substrate 21 by using an adhesive or adhesive tape. The adhesive or double-faced adhesive tape is positioned between the display electrode pairs 2 shown in FIG. 7 (the space between the display electrode pairs 2 is called a non-discharge slit since the discharge does not occur between the display electrodes). In case where the adhesive or adhesive tape is arranged at this position, the use of the black (dark) one can darken the non-discharge slit to thereby improve a contrast of the display device. A black film may be provided by separately from the adhesive or adhesive tape.

The front side substrate 21 has to be transparent from the viewpoint of the visual observation, while the back side substrate 22 does not have to be transparent, or rather, the back side substrate having a dark color is preferable for enhancing the background contrast. Further, the front side substrate 21 and the back side substrate 22 are not required to have a heat resistance like a glass since a heat treatment is not performed in later steps. Therefore, various resins (for example, acrylic resin) that are easy to be processed and are light in weight can be used for these substrates.

The electrode can be formed on the front side substrate 21 and the back side substrate 22 by the printing method or low-temperature sputtering method even if they are made of resin.

The back side substrate 22 may be provided with a recess portion as the front side substrate 21. Providing the recess portion also on the back side substrate 22 makes the data electrode 3 fixedly adhere to the gas discharge tube 1, thereby enhancing discharge characteristics of the selective discharge. Further, the gas discharge tube is strongly fixed, to thereby improve shock resistance of the display device. The arrangement of the gas discharge tube 1 becomes simple, so that work efficiency in production is enhanced.

Embodiment 2

Figure 2:
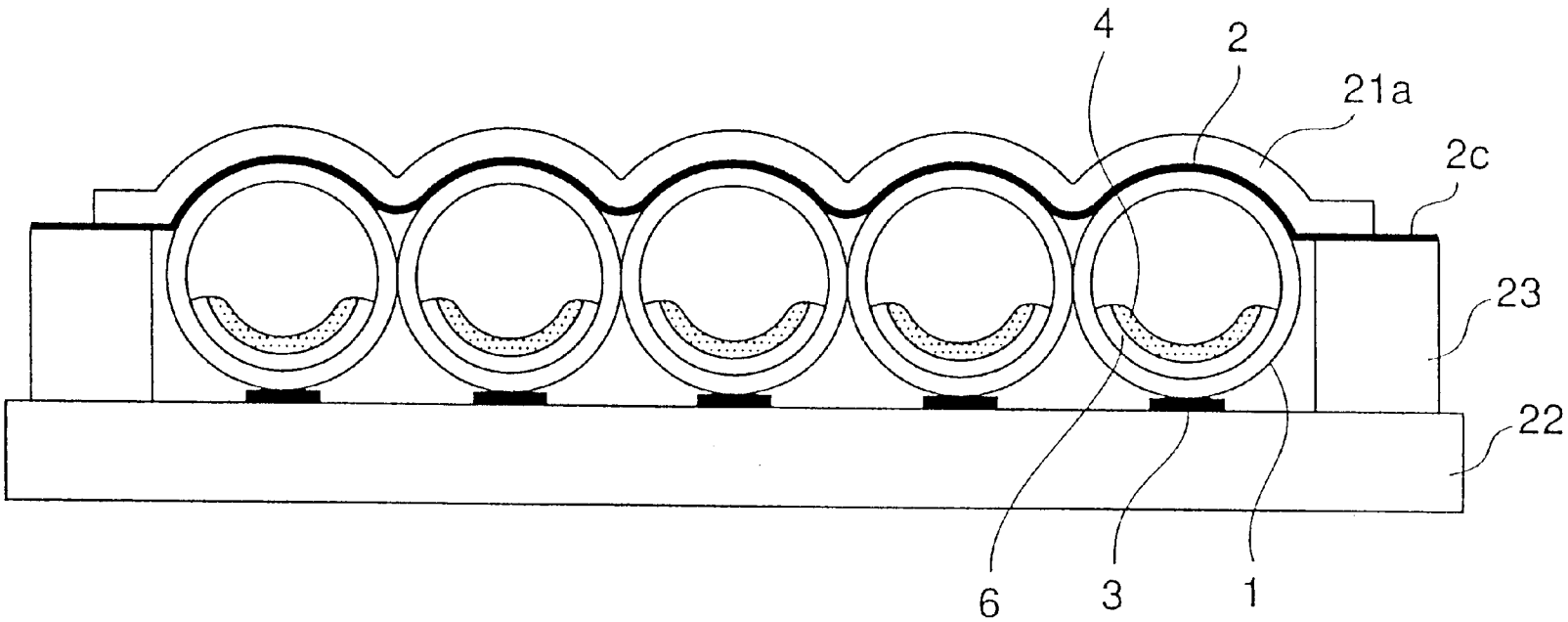
FIG. 2 is an explanatory view showing a structure of a display device in a preferred embodiment 2 according to the present invention.

FIG. 2 is an explanatory view showing a structure of a display device in the embodiment 2 according to the present invention. This figure also shows a state in which the gas discharge tube 1 is cut along the display electrode pair 2.

As shown in the figure, this embodiment utilizes a flexible sheet instead of the front side substrate 21 of the display device. Others are the same as those in the embodiment 1.

A transparent film sheet is used as the flexible sheet. A polycarbonate film or PET (polyethylene terephthalate) film, that is commercially available, can be used as this film. This film sheet is used as a front side support film 21*a*. The display electrode 2 comprising the transparent electrode such as ITO and the metallic bus electrode is formed inside the front side support film 21*a*. These electrodes are formed by a method well known to those skilled in the art such as the printing method or low-temperature sputtering method.

In this way, the display electrode pair 2 is formed inside the front side support film 21*a* that is closely adhered to the gas discharge tube 1 by using a laminate technique. This method can realize the electrode along the surface of the gas discharge tube 1, thereby enlarging the contact area between the display electrode pair 2 and the gas discharge tube 1 for enhancing the display luminance of the display device.

The front side support film 21*a* may be provided on its inner surface with a recess portion having the shape of the electrode at the position where the display electrode 2 is arranged. The display electrode 2 may be embedded into this recess portion so as not to project from the inner surface of the front side support film 21*a*. In this case, only one of the transparent electrode and the bus electrode (desirably the bus electrode) may be embedded into the recess portion.

The adhesive or adhesive tape may simultaneously be used for laminating the front side support film 21*a*. The adhesion sites are the same as in Embodiment 1.

Although a glass is used for the back side substrate 22, it is not limited to this. Various resins (for example, acrylic resin) that are easily processed and light in weight can be used for it.

The back side substrate may be provided with the recess portion as the front side substrate as shown in FIG. 1. Providing the recess portion on the back side substrate 22 can enhance the discharge characteristics of the selective discharge, since the data electrode 3 also comes in close contact with the gas discharge tube 1.

Figure 3:
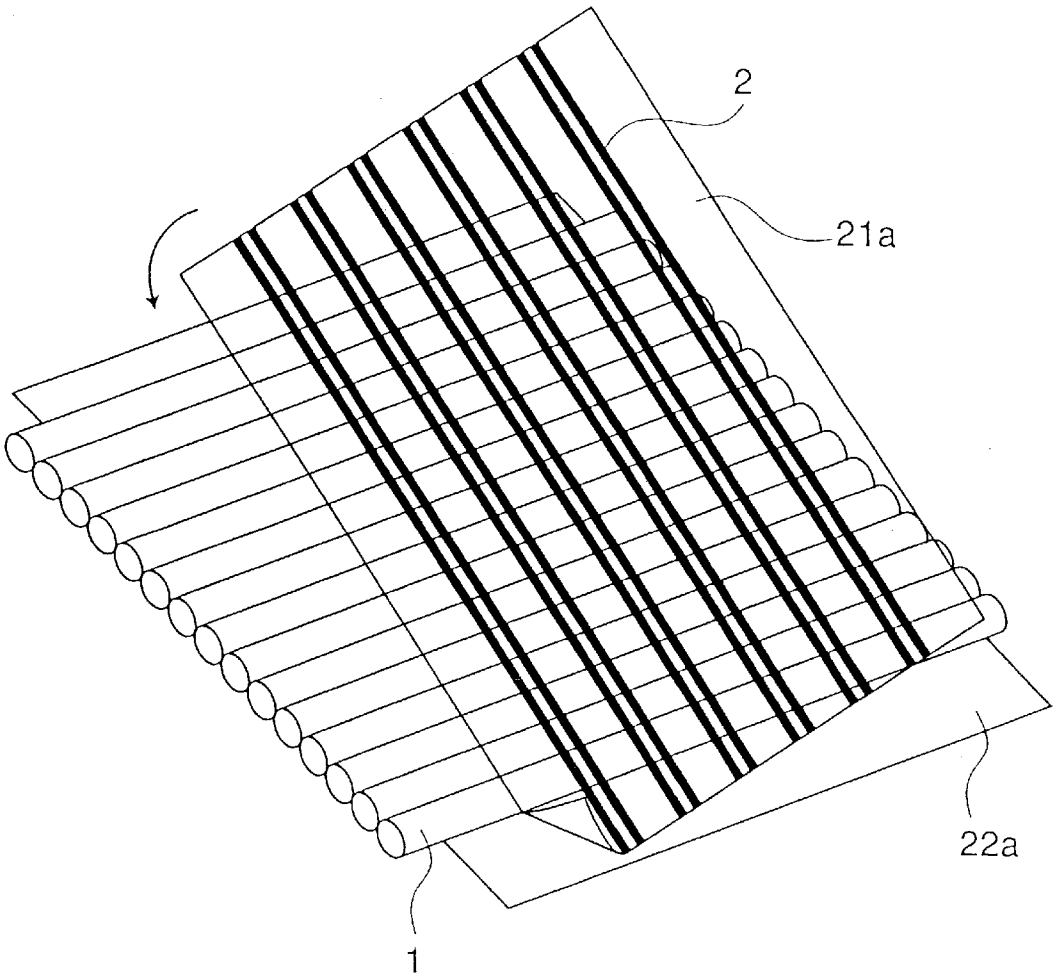
FIG. 3 is an explanatory view showing a structure of a display device wherein both of a front side substrate and a back side substrate are made of a flexible sheet.
Figure 4:
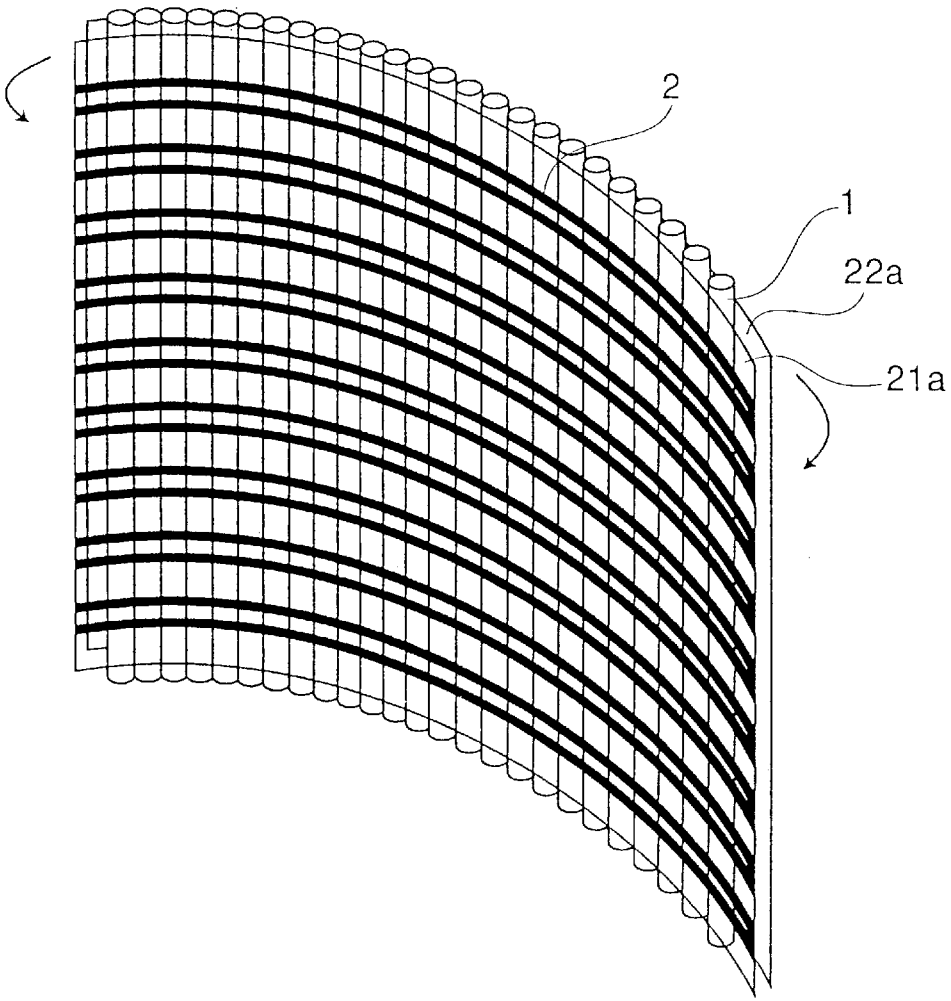
FIG. 4 is an explanatory view showing a structure of a display device wherein both of a front side substrate and a back side substrate are made of a flexible sheet.

FIGS. 3 and 4 are explanatory views each showing a structure of a display device in which both of the front side substrate and back side substrate are made of a flexible sheet.

In the above-mentioned embodiment, only the front side substrate is made of the flexible sheet, while in this embodiment, both of the front side substrate and the back side substrate are made of the flexible sheet.

The same transparent film sheet as that used for the front side is also used as the back side support film.

In this case, the front side support film 21*a* and the back side support film 22*a* are laminated on a plurality of gas discharge tubes 1 arranged in array as shown in FIG. 3.

The transparent material is used for the front side support film 21*a*, while it is not always necessary to use the transparent material for the back side support film 22*a*.

Sandwiching the gas discharge tubes 1 between the front side support film 21*a* and the back side support film 22*a* as described above enables the display device to be bent or rolled up in the direction perpendicular to the longitudinal direction of the gas discharge tube. Specifically, this can bend the display device in the direction perpendicular to the longitudinal direction of the gas discharge tube, whereby the screen size can be changed. Further, the display device can easily be carried since it can be rolled up like a bamboo blind.

Figure 5:
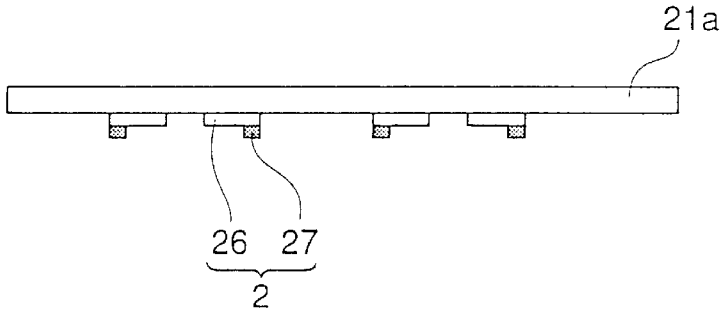
FIGS. 5(*a*) to 5(*c*) are an explanatory view showing one example of a method for manufacturing the display device shown in the preferred embodiment 2 of the present invention.
Figure 5:
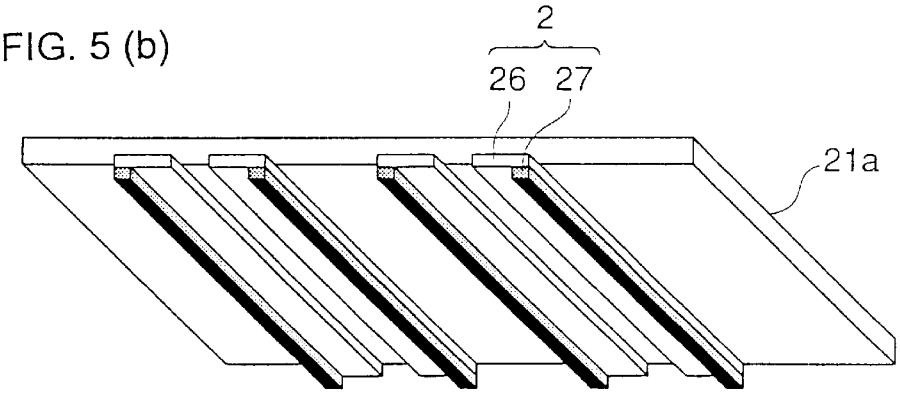
Figure 5:
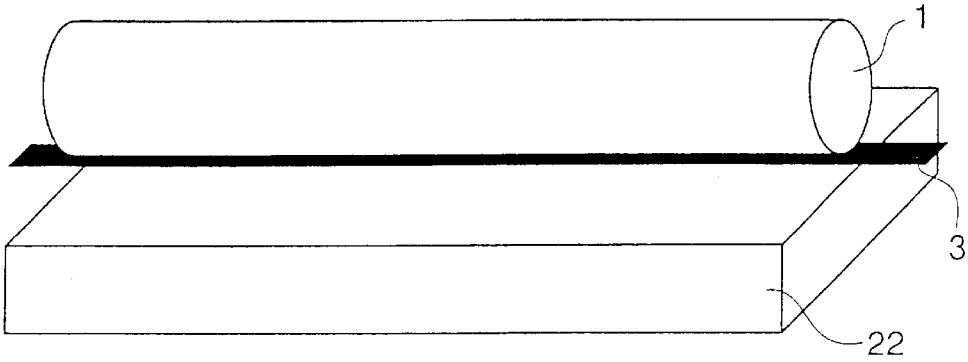

FIGS. 5(*a*) to 5(*c*) are an explanatory view showing one example of a manufacturing method of the display device shown in the embodiment 2.

Firstly, a transparent electrode 26 made of ITO is formed on the front side support film 21*a* by a photolithography technique. Then, a bus electrode 27 made of a metal is formed by the same technique (see FIG. 5(*a*)). The transparent electrode 26 and the bus electrode 27 form a single display electrode 2.

As for the back side, the data electrode 3 made of a metal is formed on the back side glass substrate 22 by the photolithography technique, and then, the gas discharge tube 1 is temporarily fixed (see FIG. 5(*c*)).

Subsequently, the front side support film 21*a* is opposed to the back side glass substrate 22 on which the gas discharge tube 1 is temporarily fixed (see FIG. 5(*b*)). The front side support film 21*a* is contacted closely with the gas discharge tube 1 by a laminate method, to thereby complete the display device.

As described above, providing the recess portion on the substrate or using the flexible sheet for the substrate enlarges the contact area between the electrodes and the gas discharge tubes, whereby the display luminance of the display device and discharge characteristics of the selective discharge can be enhanced.

The display device of the present invention has a structure in which the supporter has a shape along the display tube and the electrode comes in contact with the display tube along the surface shape of the display tube. This can establish a full contact between the electrode and the display tube, so that a sufficient effective area of the discharge electrode can fully be assured. Consequently, the display luminance of the display device can be enhanced.

What is claimed is:

1. A display device comprising:

an elongated display tube to be filled with a discharge gas and provided with a phosphor layer therein, the display tube having a curved outer surface;

a supporter having a curved support surface fitted with the curved outer surface of the display tube, to thereby support the display tube; and an electrode arranged on the curved support surface of the supporter and facing the curved outer surface of the display tube, for externally applying a voltage to the display tube to generate discharge in the display tube so as to perform a display, wherein the electrode is in contact with the display tube along the curved outer surface of the display tube over an entire length in an extension direction of the electrode along which the curved support surface of the supporter is fitted with the curved outer surface of the display tube.

2. The display device of claim 1, wherein the supporter comprises a pair of substrates, at least one of which has a transparency, the display tube is sandwiched between the pair of substrates, and said at least one substrate having the transparency is provided with a recess portion having a shape fitting the surface shape of the display tube.

3. The display device of claim 1, wherein the supporter is made of a substrate having a rigidity and a flexible sheet having a transparency, the display tube is sandwiched between the substrate and the flexible sheet and the flexible sheet is laminated along the surface shape of the display tube.

4. The display device of claim 1, wherein the supporter is made of a pair of flexible sheets, at least one of which has a transparency, and the pair of flexible sheets is laminated so as to sandwich the display tube, whereby the pair of flexible sheets can be deformed in a direction perpendicular to the longitudinal direction of the display tube.

5. The display device of claim 1, wherein the electrode is composed of a transparent electrode and a metal electrode.

6. A display device as in claim 1, wherein the electrode extends in a lateral direction across the display tube.

7. A display device comprising:

a tube array in which a plurality of elongated display tubes are arranged in parallel, each of said plurality of elongated tubes being filled with a discharge gas and provided with a phosphor layer and having a curved outer surface;

a pair of supporters having curved outer surfaces fitted with the curved outer surfaces of the display tubes, to thereby support the tube array;

a plurality of display electrode pairs arranged on the curved outer surface of one of the supporters and facing the curved outer surfaces of the display tubes of the tube array and in a direction crossing the display tubes, for externally applying voltage to each of the display tubes to generate a display discharge in each of the display tubes; and data electrodes arranged in parallel to the display tubes on a surface of the other of the supporters facing the tube array, for generating a selective discharge between the display electrodes and the data electrodes, wherein the display electrode pairs are in contact with the display tubes along the curved outer surfaces of the display tubes over an entire length in an extension direction of the display electrode pairs along which the curved outer surface of said one of the supporters is fitted with the curved outer surfaces of the display tubes.

8. The display device of claim 7, wherein the pair of supporters is a pair of substrates, at least one of which has a transparency, the tube array is sandwiched between the pair of substrates, and said at least one of the substrates having the transparency is provided with a recess portion having a shape fitting the surface shape of the display tubes.

9. The display device of claim 7, wherein the pair of supporters is made of a substrate having a rigidity and a flexible sheet having a transparency, the tube array is sandwiched between the rigid substrate and the flexible sheet, and the flexible sheet is laminated along the surface shape of the display tubes.

10. The display device of claim 7, wherein the pair of supporters is made of a pair of flexible sheets, at least one of which has a transparency, and the pair of flexible sheets is laminated so as to sandwich the tube array, whereby the pair of flexible sheets can be deformed in a direction perpendicular to the longitudinal direction of the display tubes.

11. The display device of claim 9 or 10, wherein the display electrode pairs are provided on an inner surface of the transparent flexible sheet.

12. The display device of claim 7, wherein the display electrode pairs are composed of a transparent electrode and a metal electrode.

13. A display device comprising:

a display tube having a curved outer surface;

a supporter having a curved support surface fitted with the curved outer surface of the display tube, to thereby support the display tube; and a display electrode arranged on the curved support surface of the supporter and facing the curved outer surface of the display tube, to externally apply a voltage to the display tube to generate a display discharge in the display tube, the display electrode in contact with the display tube along the curved outer surface of the display tube over an entire length in an extension direction of the display electrode along which the curved support surface of the supporter is fitted with the curved outer surface of the display tube.

14. A display device comprising:

a display tube having a curved outer surface;

a supporter having a curved support surface fitted with the curved outer surface of the display tube, to thereby support the display tube; and an electrode arranged on the curved support surface of the supporter and facing the curved outer surface of the display tube, the electrode in contact with the display tube along the curved outer surface of the display tube over an entire length in an extension direction of the electrode along which the curved support surface of the supporter is fitted with the curved outer surface of the display tube.

* * * * *